United States Patent [19]

Sharpe et al.

[11] Patent Number: 4,951,888

[45] Date of Patent: Aug. 28, 1990

[54] REFINING ELEMENT AND METHOD OF MANUFACTURING SAME

[75] Inventors: Patrick E. Sharpe, Williamsport, Pa.; Ole A. Sandven, Georgetown, Mass.

[73] Assignee: Sprout-Bauer, Inc., Muncy, Pa.

[21] Appl. No.: 397,930

[22] Filed: Aug. 24, 1989

[51] Int. Cl.[5] ..... B02C 7/12

[52] U.S. Cl. ..... 241/296; 241/300; 51/309; 219/137 R

[58] Field of Search ..... 241/296, 297, 298, 300; 219/76.1, 76.14, 121.12, 121.17, 121.6, 121.65, 121.66, 137 R; 51/295, 309

[56] References Cited

U.S. PATENT DOCUMENTS

| | | | |
|---|---|---|---|
| Re. 29,815 | 10/1974 | Gnanamuthu | 219/121 |
| 3,910,511 | 10/1975 | Leider et al. | 241/298 X |
| 4,039,154 | 8/1977 | Peterson | 241/261.3 |
| 4,351,489 | 9/1982 | Laptiv et al. | 241/298 X |
| 4,372,495 | 2/1983 | Marton et al. | 241/28 |
| 4,401,726 | 8/1983 | Gnanamuthu | 428/610 |
| 4,712,745 | 12/1987 | Leith | 241/261.3 |
| 4,767,070 | 9/1988 | Nagao | 241/296 X |

FOREIGN PATENT DOCUMENTS 8600546 1/1986 PCT Int'l Appl. .

OTHER PUBLICATIONS

C-E Industrial Lasers, Inc., Brochure: "Laser Cladding and Alloying", Jul. 1986.

*Primary Examiner*—Timothy V. Eley
*Attorney, Agent, or Firm*—William W. Habelt

[57] ABSTRACT

A refiner element (10) for the refining of fibrous material is provided with a comminuting surface of which at least a portion comprises an abrasive surface. The method of forming the refiner element (10) comprises casting a metal substrate (20) having a frontal surface (22), melting a relatively thin layer of the metal substrate on the frontal surface thereof to form a molten pool in the comminuting surface over the region thereof on which an abrasive surface is desired, depositing an abrasive material (38) into the molten pool formed in the metal comminuting surface (22) of the refiner element (10), and allowing the molten metal pool into which the abrasive material (38) has been deposited to solidify whereby the particles of abrasive material (38) are strongly bonded into the metal surface of the refining element to form the abrasive comminuting surface thereon. Most advantageously, the melting of a thin layer of the frontal surface (22) on the metal substrate (20) of the refiner element (10) is accomplished by directing unto the comminuting surface a laser beam (88) of sufficient intensity to melt the surface to a pre-determined depth.

35 Claims, 5 Drawing Sheets

REFINING ELEMENT AND METHOD OF MANUFACTURING SAME

BACKGROUND OF THE INVENTION

The present invention relates to refining elements for use in the refining of various fibrous materials, such as cellulosic and lignocellulosic materials, including wood chips, raw or pretreated, and wood pulp, and particularly to a method of manufacturing a refining element with an abrasive comminuting surface and the refining element produced thereby.

Various fibrous materials, such as wood chips, whether raw or pretreated with steam and/or chemicals, are commonly mechanically refined, i.e., defibered, in an apparatus known as a rotating disc refiner. In such devices, the fibrous material is defibered or refined by mechanical action during its passage through a narrow gap between two closely spaced opposed working surfaces. These working surfaces generally comprise annular refining plates formed of a plurality of truncated circular sector shaped elements arranged in circumferentially adjacent relationship to form an annular comminuting surface. Due to rotation of one or both of the working surfaces, the fibrous material is defibered by mechanical action as it passes outwardly from the inner radius of the refiner plates to the outer radius of the refiner plates under the forces of rotation.

A typical refining plate useful in such disc refiners for refining fibrous materials, in particular wood chips, is formed of a plurality of truncated circular sector-shaped elements disposed in circumferentially adjacent relationship to form an annular comminuting surface. The comminuting surface of the face of each refining element is divided by one or more circular arcs into a plurality of refining regions, typically two or three. The first region, comprising the radially inwardmost region, is provided with a series of substantially radially directed breaker bars forming a series of relatively widely spaced ridges and grooves. The second region, which lies radially outward of the first region and adjacent thereto, is provided with a series of somewhat thinner substantially radially extending bars forming a series of narrower more closely spaced ridges and grooves. If there is a third region, it lies radially outward of and adjacent to the second region, i.e., the intermediate region, and it is provided with even thinner substantially radially extending bars forming a series of still narrower and even more closely spaced ridges and grooves.

Another type of refining element useful in such disc refiners for refining fibrous materials, in particular wood chips, is presented in U.S. Pat. No. 4,372,495. As disclosed therein, the refining plate is formed of a plurality of truncated circular sector-shaped elements disposed in circumferentially adjacent relationship to form an annular comminuting surface. The comminuting surface on the face of each refining element is divided by an arc of a circle into adjacent first and second regions, the first region being radially inward of the second region, with the first region being provided with a series of breaker bars forming a series of relatively widely spaced ridges and grooves, and the second region lying radially outward of the first region and being provided with an abrasive disintegrating surface formed by abrasive particles having an average grit size of between about 12 and 120 grit, i.e., about 140 micrometers to 0.25 centimeters. The abrasive material may be a ceramic material, such as silica, alumina, silicon carbide, zirconia and tungsten carbide.

The abrasive surface of the refining elements disclosed in U.S. Pat. No. 4,372,495 is formed by brazing ceramic particles, generally tungsten carbide grit of 36 grit, to the surface of the stainless steel element. The process is carried out by applying a layer of brazing powder, typically having a nickel-chromium-boron matrix, to the stainless steel substrate of the refiner element. After the brazing powder is applied to a thickness of 0.010 to 0.015 inches, the tungsten carbide powder is applied in a single layer over the brazing powder layer. The tungsten carbide powder is then wetted with a fluoride based flux. This layering process is repeated several times until an overall coating thickness of 0.090 inches is obtained. After the coating mixture is dried, the refining element is placed in a vacuum furnace which is brought up to brazing temperature over an eight hour period. The refining element is held at a brazing temperature of 2050° F. for a period of one hour. The refining element is then allowed to cool in the vacuum furnace for one hour to a temperature below 1OOO° F., after which the brazed refiner plate is removed and allowed to cool overnight.

In addition to being very time consuming, labor intensive, this brazing process produces an abrasive layer which is subject to flaking of the abrasive layer from the metal substrate due to built-in stress that results in the coating bond as the brazed element cools as a result of the difference in the coefficients of thermal expansion of the tungsten carbide grit and the stainless steel substrate.

Another problem is warping of the refiner elements during the brazing process. Often the refiner elements must be placed in the furnace for a second brazing to achieve a strong bond or to repair an incomplete or flaked coating. Further, the effectiveness of the abrasive coating is reduced as the abrasive grit is glazed over during the brazing process thereby dulling the sharp edges of the grit.

It is an object of the present invention to provide a method of manufacturing a refining element having an abrasive comminuting surface without brazing the abrasive particles to the metallic substrate of the refiner elements thereby avoiding subjecting the refiner elements to high furnace temperatures.

It is a further object of the present invention to provide a refiner element, and a refiner plate formed of a plurality of such refiner elements, having at least a region of its comminuting surface comprising an abrasive surface formed by abrasive particles implanted into, rather than brazed onto, the metallic substrate of the refiner element.

SUMMARY OF INVENTION

In accordance with the present invention, a refiner element for the refining of fibrous material is provided with a comminuting surface of which at least a portion comprises an abrasive surface. The method comprises forming a refining element having a metal substrate and a metal comminuting surface formed on the metal substrate, melting a relatively thin layer of the metal substrate to form a molten pool in the comminuting surface over the region thereof on which an abrasive surface is desired, depositing an abrasive material into the molten pool formed in the metal comminuting surface of the refiner element, and allowing the molten metal pool into which the abrasive material has been deposited to solidify whereby the particles of abrasive material are strongly bonded into the metal comminuting surface of the refining element to form the abrasive surface thereon. Most advantageously, the melting of a thin layer of the comminuting surface on the metal substrate of the refiner element is accomplished by directing unto the comminuting surface a laser beam of sufficient intensity to melt the surface to a pre-determined depth.

The improved refining element, and the refining plate formed of a plurality of such refining elements, has at least a region of its comminuting surface comprising an abrasive material deposited onto the metallic comminuting surface of the refiner element while that region of the comminuting surface was in a molten state and bonded into the comminuting surface upon solidification of the molten comminuting surface. The abrasive material may comprise a ceramic material such as silica, alumina, silicon carbide, zirconia and tungsten carbide. Most advantageously, the abrasive material comprises tungsten carbide grit having a grit size between about 30 and 40 grit.

BRIEF DESCRIPTION OF THE DRAWING

The method and apparatus of the present invention may be best understood from the following detailed description wherein reference is made to the accompanying drawings, in which.

DETAILED DESCRIPTION

Figure 1:
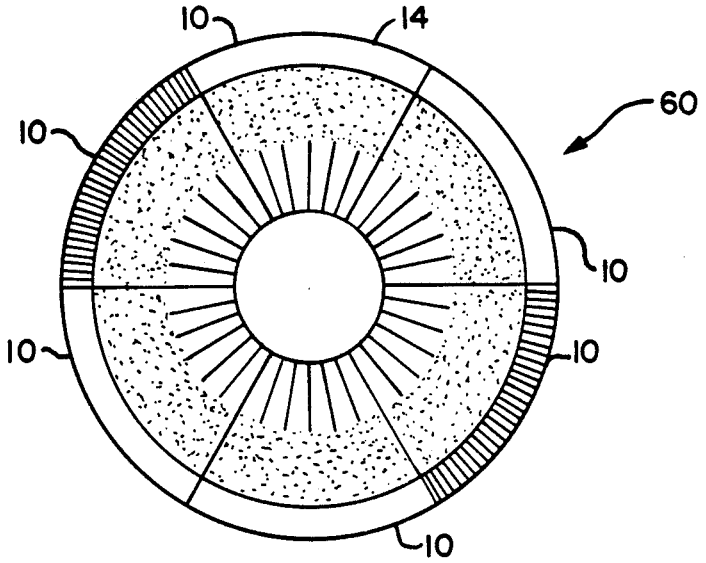
FIG. 1 is a frontal elevational view of a refiner plate formed of a plurality of refiner elements.

Referring now to the drawing, there is depicted in FIG. 1 thereof an annular refining plate 60 comprised of a plurality of refiner elements 10. Each refiner element 10 is in the shape of a truncated circular sector having an inner radius defining the inner edge 12 of the refiner element and an outer radius defining the outer edge 14 of the refiner element. The lateral edges 16 and 18 lie along radial lines extending radially outwardly from the center of a circle of which the refiner element would be a truncated circular sector.

Each refiner element 10 comprises a metallic substrate 20, typically a stainless steel substrate and generally formed by casting, having a frontal or face surface 22 which comprises the working surface of the refiner element 10 and a back 24 which is adapted to abut a plate holder when the refiner element 10 is installed into a refining apparatus for refining fibrous material, such as, for purposes of illustration but not limitation, refining apparatus of the type disclosed in U.S. Pat. Nos. 3,441,227; 3,765,613; 3,847,359; or 3,276,701. Typically, mounting holes 26 are formed through the refiner element 10 for bolting the refiner element 10 to a plate holder. To form a refiner plate 60, a plurality of the truncated circular sector shaped refiner elements 10 are arranged in circumferentially adjacent relationship to form annular disc-like plate as best seen in FIG. 1.

Figure 2:
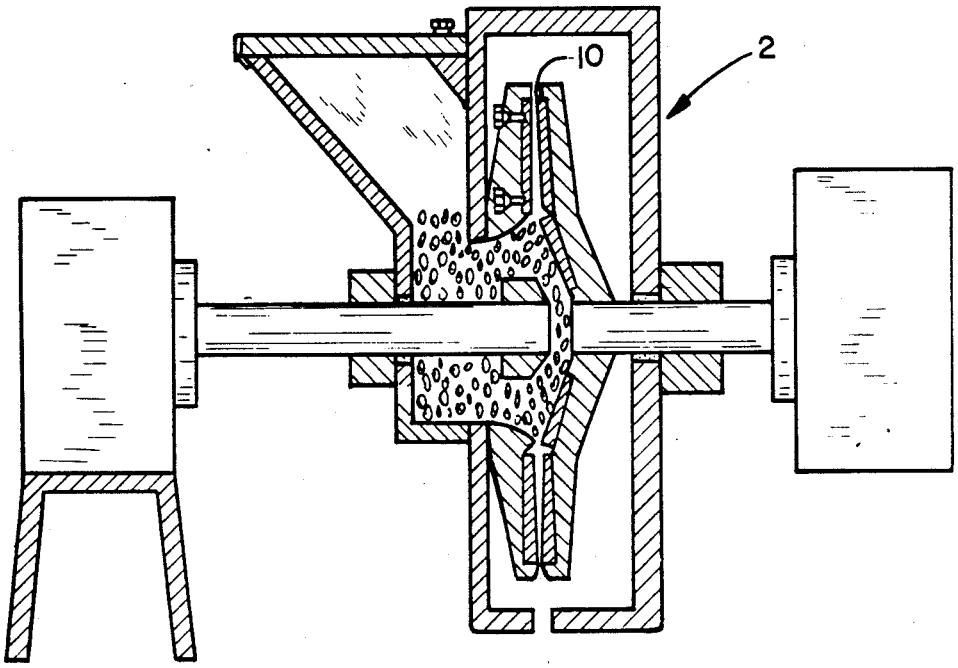
FIG. 2 is a side elevational view of a refiner apparatus incorporating a disc-like pair of the refiner plates of FIG. 1.

When installed, the frontal or face surface 22 of the metallic substrate 20 of each refiner element 10 forms a comminuting surface which faces in opposed face to face relationship the comminuting surface of another refiner plate as illustrated in FIG. 2. In operation of the refiner 50, fibrous material is defibered as it is worked radially outwardly from the inner edge of the refiner plate 60 to the outer edge of the refiner plate 60 under the forces generated upon relative rotation of the opposed plates, whether only one or both of the opposed plates are rotating.

Advantageously, the comminuting surface 22, that is the frontal or face surface of the metallic substrate 20 of the refiner element 10 comprises a radially inward first refining zone 40 and at least a second refining zone 44 between the inner radial edge 12 and the outer radial edge 14 of the refining element 10 with the second refining zone 44 lying radially outward of and adjacent the first refining zone 40, and typically, although not necessarily, a third refining zone 50 lying radially outward of the second refining zone 44 and extending therefrom to the outer radial edge 14 of the refiner element.

In the refiner element of the present invention, the first refining zone 40 includes a plurality of breaker bars 42 formed therein which extend longitudinally from the vicinity of the inner edge 12 of refiner element 10 across the first refining zone 40 at relatively widely spaced intervals. The breaker bars 42 are relatively thick bars, typically up to about 0.75 inches in width, and foreshortened so as not to extend into the second refining zone 44. Each bar 42 extends along a longitudinal axis which may lie along a radius of the circle of which the refiner element is a truncated circular sector or along a longitudinal axis which is parallel to, or outset by a few degrees, typically less than 30 degrees, from the nearest of the lateral edges 16 and 18 of the refiner element 10. In any case, such bars 42 are conventional in the prior art and serve to work the fibrous material supplied to the first refining zone to initially break down the fibrous material into matchstick-like fragments.

The fibrous material exiting radially outward from the first refining zone 40 passes through one or more additional refining zones, typically two, and is progressively worked into smaller fibers as it traverses the additional refining zones. In accordance with the present invention, at least one of the additional refining zones has an abrasive comminuting surface formed by abrasive particles 38 bonded to the metallic substrate 20 of the refiner element 10. When the second refining zone constitutes the radially outwardmost refining zone, i.e., when no third refining zone is present, the pulp produced during refining passes outwardly from the refining gap between the opposed relatively rotating refiner plates together with steam generated during the refining process which assists the centrifugal movement of the pulp. When a third refining zone 50 is provided, the pulp passes from the second refining zone through the third refining zone 50, which is provided on the comminuting surface 22 of the refiner element 10 radially outward of the second refining zone 44 and adjacent the outer radial edge 14 of the refining element 10. As the pulp leaves the third refining zone 50, it passes outwardly from the refining gap between the opposed relatively rotating refiner plates together with steam generated during the refining process.

In accordance with the present invention, the abrasive surface is provided by abrasive particles 38 deposited onto the metallic substrate 20 of the refiner element 10 when a relatively thin layer at the frontal surface 22 of the metallic substrate 20 within the second refining zone 44 or the third refining zone 50 is in a molten state. These abrasive particles are bonded directly into the metallic substrate upon solidification of the relatively thin molten layer to form the abrasive comminuting surface on the surface of refiner element 10. Unlike prior art refiner elements having an abrasive comminuting surface formed by brazing a coating of abrasive grit unto the metallic substrate of the refiner element, the abrasive particles 38 are actually bonded into the metallic substrate 20 upon solidification of the molten surface layer of the substrate thereby forming an abrasive surface which is not subject to the flaking problem which has plagued prior art refiner elements having abrasive coatings brazed thereon. As disclosed in U.S. Pat. No. 4,372,495, the entire disclosure of which is hereby incorporated by reference, the abrasive particles may have a grit size ranging from about 12 grit to about 120 grit, that is a particle size ranging from about 140 micrometers to about 0.25 centimeters. The abrasive may be a ceramic material and advantageously may be a ceramic material selected from silica, alumina, silicon carbide, zirconia and tungsten carbide.

Figure 3:
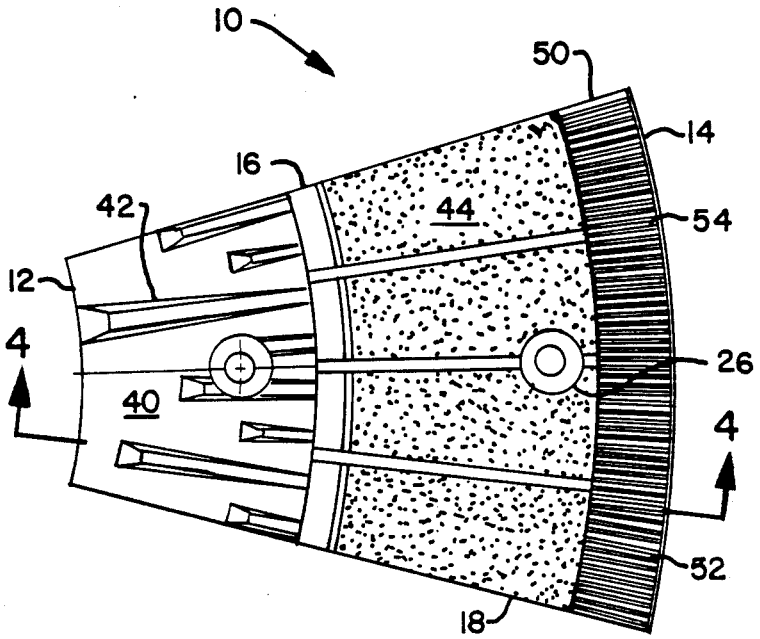
FIG. 3 is a frontal elevational view of one embodiment of the abrasive refiner element of the present invention.
Figure 4:
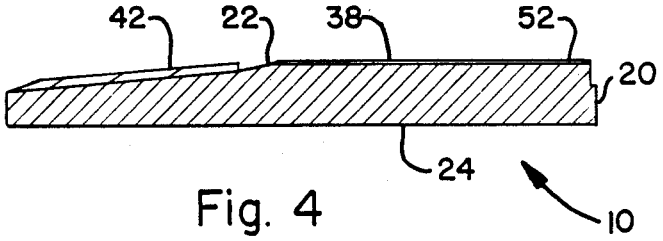
FIG. 4 is a sectional side view of the embodiment of the abrasive refiner element of the present invention illustrated in FIG. 3.

In the embodiment of the refiner element of the present invention illustrated in FIGS. 3 and 4, the second refining zone 44 extends from the outer edge of the first refining zone 40 to the inner radical edge of the third refining zone 50. The second refining zone 44 comprises an abrasive comminuting surface formed by abrasive particles 38 bonded to a substantially flat metallic substrate, that is a substrate without ridges, although, if desired, widely spaced shallow, typically 0.125 inch deep, and rather wide, typically about 0.5 inch wide, generally radially directed grooves may be cut in the otherwise substantially flat metallic substrate of the second refining zone 44. The abrasive particles 38 are deposited onto the metallic substrate 20 of the refiner element 10 when a relatively thin layer at the frontal surface 22 of the metallic substrate 20 within the second refining zone 44 is in a molten state. These abrasive particles are bonded directly into the metallic substrate upon solidification of the relatively thin molten layer to form the abrasive comminuting surface on the surface of refiner element 10 to depth of about 0.06 inches within the second refining zone 44.

In this embodiment, the third refining zone most advantageously includes a plurality of relatively thin, generally radially directed, closely spaced bars 52 which define a series of narrow ridges and grooves on the comminuting surface 22 of the third refining zone 50. In a typical embodiment of the refiner element 10 of FIG. 3, the relatively thin bars 52 would have a width and height of about 0.06 inches and be arranged at a spacing of about 0.19 inches to provide between each pair of juxtaposed bars 52 a shallow, narrow gap 54. The relatively thin bars 52, like the breaker bars 42, are typically formed integrally with the underlying metallic substrate 20 during the casting of the refiner element 10.

Figure 5:
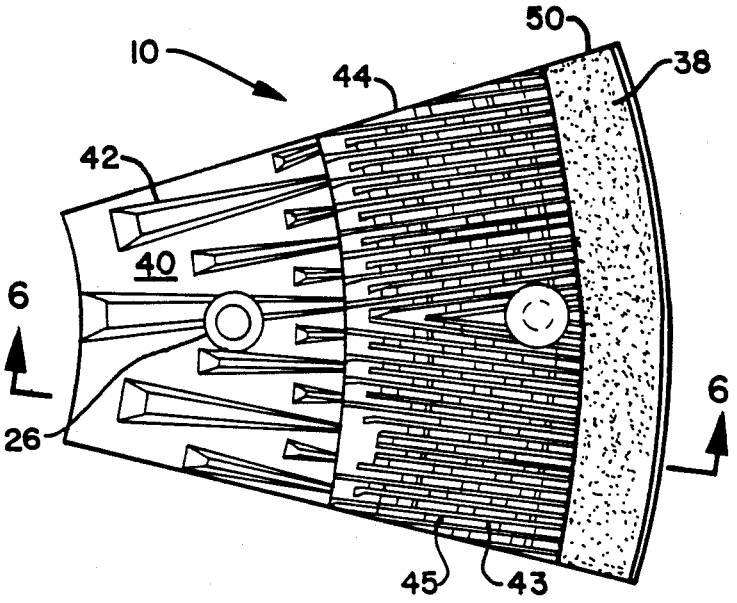
FIG. 5 is a frontal elevational view of another embodiment of the abrasive refiner element of the present invention.
Figure 6:
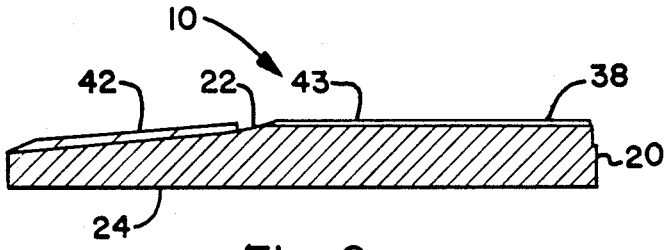
FIG. 6 is a sectional side view of the embodiment of the abrasive refiner element of the present invention of FIG. 5.

In the embodiment of the refiner element of the present invention illustrated in FIGS. 5 and 6, the second refining zone 44 also extends from the outer edge of the first refining zone 40 to inner radial edge of the third refining zone 50, but rather than having a substantially flat abrasive comminuting surface as in the embodiment illustrated in FIGS. 3 and 4, the refiner element shown in FIGS. 5 and 6 is provided with a series of ridges and grooves. To establish the ridges and grooves, a plurality of generally radially directed bars 43 are provided on the comminuting surface of the second refining zone at spaced intervals. The upper surface of the bars 43 form the ridges while the spaces between juxtaposed bars 43 form the grooves. Preferably, transversely extending barrier bars 45 are disposed at widely spaced intervals in the grooves between juxtaposed bars 43 to prevent direct channel flow of the material being refined through the second refining zone 44. The bars 43 are typically thicker than and more widely spaced than the relatively thin, closely spaced bars 52 of the third refining zone 50, but thinner than and more closely spaced than the relatively thick, widely spaced breaker bars 42 of the first refining zone 40.

In the refiner element 10 of FIG. 5, wherein the second refining zone 44 is provided with a series of ridges and grooves without an abrasive coating, the third refining zone 50 is provided with an abrasive surface formed by depositing abrasive grit particles 38 unto the comminuting surface of the third refining zone 50 when the surface thereof is in a molten state. The abrasive grit particles 38 are bonded to the top surface of the third refining zone 50 upon resolidification to provide an abrasive layer typically about 0.06 inch thick.

Figure 7:
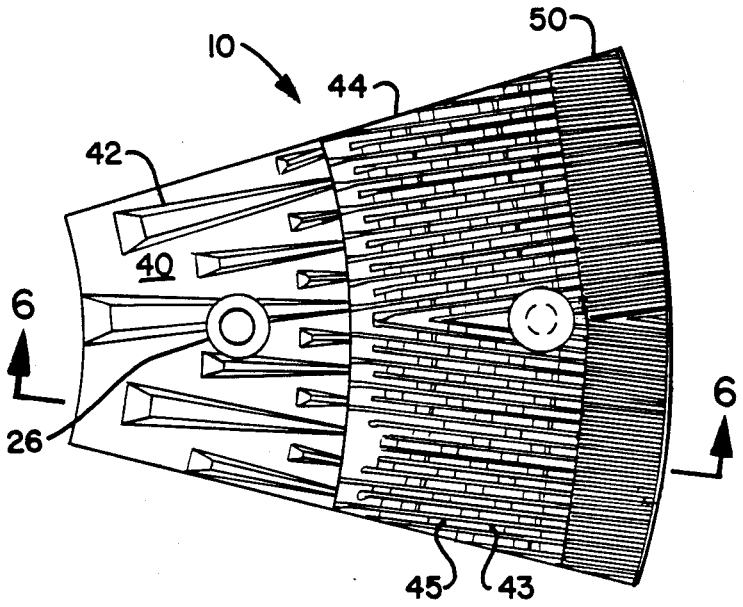
FIG. 7 is a frontal elevational view of still another embodiment of the abrasive refiner element of the present invention.
Figure 8:
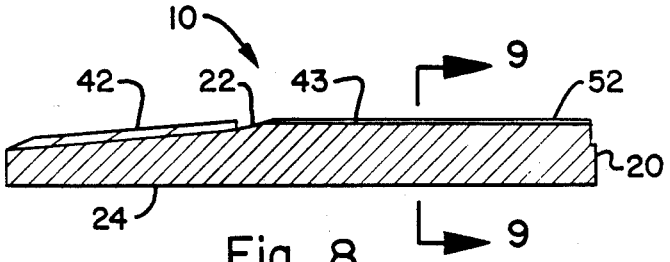
FIG. 8 is a sectional side view of the embodiment of the abrasive refiner element of the present invention of FIG. 7.
Figure 9A:
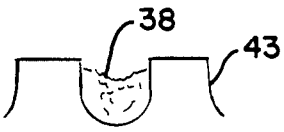
FIGS. 9*a* and 9*b* are cross-sectional views of the embodiment of the abrasive refiner element of the present invention of FIG. 7 taken along line 9—9 FIG. 8.
Figure 9B:
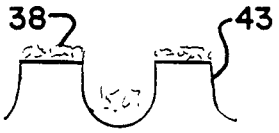

In the embodiment of the refiner element 10 of the present invention illustrated in FIGS. 7 and 8, the second refining zone 44 is provided with a series of ridges and grooves wherein an abrasive surface,has been provided in the grooves only, as illustrated in FIG. 9*a*, or on the ridges only, as illustrated in FIG. 9*b*. When the abrasive surface is provided in the groove, sufficient abrasive grit is deposited into each groove when the surface thereof is in a molten state and bonded to the metallic substrate and walls of the bars 43 upon resolidification to fill the groove to a level typically about 1/32 inch below the ridge of the bars 43. If the abrasive surface is provided on the ridges, sufficient abrasive grit is deposited unto each ridge of the bars 43 when the surface thereof is in a molten state and bonded to the top surface of the bars 43 upon resolidification to provide an abrasive layer typically about 0.06 inch thick.

In this embodiment, the third refining zone most advantageously includes a plurality of relatively thin, generally radially directed, closely spaced bars 52 which define a series of narrow ridges and grooves on the comminuting surface 22 of the third refining zone 50. In a typical embodiment of the refiner element 10 of FIG. 7, the relatively thin bars 52 would have a width and height of about 0.06 inches and be arranged at a spacing of about 0.19 inches to provide between each pair of juxtaposed bars 52 a shallow, narrow gap 54. The relatively thin bars 52, like the breaker bars 42, are typically formed integrally with the underlying metallic substrate 20 during the casting of the refiner element 10.

In accordance with the method aspect of the present invention, an abrasive comminuting surface over at least a portion of the second refining zone 50 by forming a refining element comprising a metallic substrate 20 having a comminuting surface 22, melting a relatively thin layer of the metallic substrate to form a molten pool 46 over the portion of the comminuting surface of the refining element 10 on which an abrasive surface is desired, be it the entire comminuting surface or a limited portion thereof, such as the ridges of the bars or the grooves therebetween, thence depositing the abrasive grit particles 38 into the molten pool 46, and allowing the molten pool to solidify whereby the abrasive particles are strongly bonded into the metallic substrate 20 to form the abrasive comminuting surface.

Most advantageously, the melting of a relatively thin layer at the frontal surface 22 of the metallic substrate 20 is accomplished by directing a laser beam onto the comminuting surface 22 of metallic substrate 20. As illustrated in FIG. 4, the refiner element 10 to be provided with an abrasive comminuting surface over at least a portion thereof is arranged for passing under a laser. The non-abrasive refiner element 10 is formed by conventional casting techniques well known in the prior art and comprises a metallic substrate 20 having a frontal face on which the abrasive comminuting surface is to be formed.

To form the abrasive surface on the metal substrate, the refining element is passed under a laser apparatus 80. As the portion of the frontal face of the metal substrate to which the abrasive surface is to be applied passes under the laser apparatus 80, a laser beam 88 is directed onto the frontal face 22 of the refiner element 10. Special optical components operatively associated with the laser apparatus 80 serve to shape the laser beam into a line source with a scan width of about 0.10 inches to about 0.50 inches. The laser apparatus 80 may comprise a high-power carbon dioxide laser having a power output of 3 to 8 kilowatts. The intensity of the energy flow to the refiner element 10 via the laser beam 88 must be sufficient to local melting of the frontal face of the metal substrate 20 to a preselected relatively thin depth, without excessive bulk heating of the substrate 20 of the refiner element 10.

Figure 10:
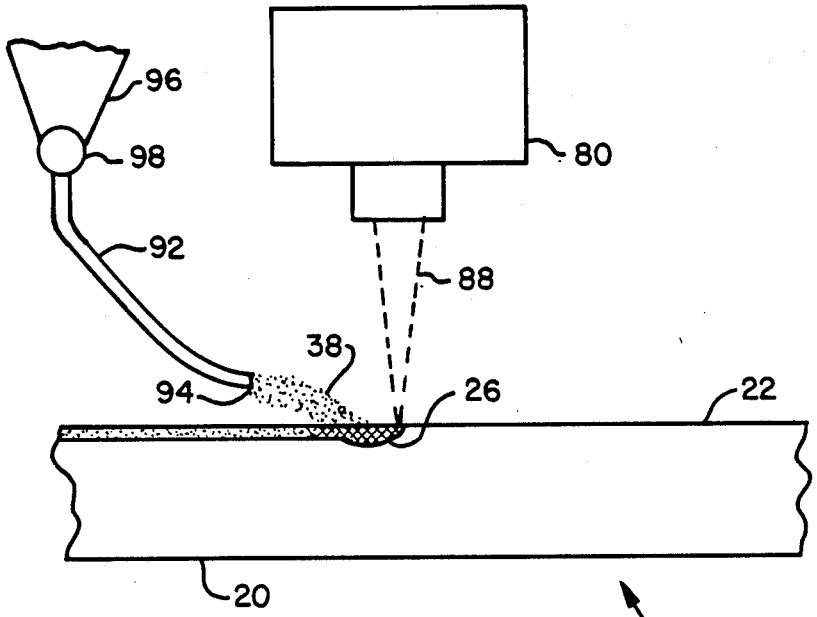
FIG. 10 is a side elevational view illustrative the application of a laser beam and deposit of abrasive grit in manufacturing a refiner element.

As best seen in FIG. 10, feeder means 90 is positioned downstream of the laser apparatus 80 such that the abrasive grit material 38 may be deposited into the molten pool 26 formed on the frontal face 22 of the substrate 20 upon melting thereof by the laser beam 88. The feeder means 90 may simply comprise a tubular conduit 92 having a duckbilled tip 94 which has a width slightly less than the scan width of the laser beam 88. The tubular conduit 92 is connected in flow communication with a supply hopper 96 through a feed control valve 98 to receive abrasive grit 38 at a controlled rate from the supply hopper 96. The speed at which the refiner element 10 is passed under the laser beam 88 and the feed rate of abrasive grit material 38 is deposited into the molten pool 26 may be adjusted to control the degree of abrasiveness, the degree of bonding, and depth of abrasive coating imparted to the comminuting surface of the refiner element 10.

Refiner elements having an abrasive grit surface over at least a portion of the comminuting surface of the refiner element have been produced in accordance with the present invention by passing a cast refiner element blank made of stainless steel under a high energy laser beam generated by a 5000 watt carbon dioxide laser at a processing speed of 36 inches per minute. The laser beam had a scan frequency of 50 Hz and a scan width of 0.4375 inches. Tungsten carbide powder, having a particle size of 36 grit, was deposited into the molten pool formed by the laser beam through a 0.25 inch O.D. copper tube having a tip duckbilled to 0.3125 inch at a feedrate of 46.5 grams per minute.

As the refiner elements of the present invention are provided with an abrasive comminuting surface wherein the abrasive grit is bonded directly into the metal substrate of the refiner element upon resolidification of the molten pool into which the abrasive grit was deposited, an extremely strong bond of the grit to the substrate is formed. As a result, the refiner elements of the present invention are not subject to flaking of the abrasive grit as is experienced with the brazed on abrasive surfaces of the prior art and consequently have a longer wear life.

Additionally, as the refiner elements are not subjected to repeated bulk heating at high temperatures, warpage of the refiner elements is eliminated, which also leads to extended service life. Further, the abrasive grit applied to a refiner element produced in accordance with the present invention remains sharp which provides a better comminuting surface than obtained on prior art elements wherein the abrasive grit is glazed over during the brazing process.

We claim:

1. A method of manufacturing a refining element for refining of fibrous material, the refining element having a comminuting surface of which at least a portion comprises an abrasive surface, said method comprising the steps of:

a. providing a refining element having a metal comminuting surface;

b. melting a relatively thin layer of the metal comminuting surface of said refining element to form a molten pool over the region of said refining element on which an abrasive surface is desired;

c. depositing an abrasive material into the molten pool formed in the metal comminuting surface of said refining element; and d. allowing the molten pool in the metal comminuting surface of said refining element to solidify whereby the abrasive material deposited therein is strongly bonded into the metal comminuting surface of said refining element to form an abrasive surface thereon.

2. A method as recited in claim 1 wherein the step of melting a relatively thin layer of the metal comminuting surface of said refining element to form a molten pool over the region of said refining element on which an abrasive surface is desired comprises directing a laser beam onto the metal comminuting surface of said refining element over said region, said laser beam having an intensity sufficient to melt the metal comminuting surface to a pre-determined depth.

3. A method as recited in claim 2 wherein the abrasive material is a ceramic material.

4. A method as recited in claim 3 wherein the ceramic material is selected from the group consisting of silica, alumina, silicon carbide, zirconia and tungsten carbide.

5. A method as recited in claim 2 wherein the laser beam directed onto the metal comminuting surface is generated by a high power carbon dioxide laser apparatus.

6. A method as recited in claim 5 wherein said high power carbon dioxide laser apparatus has a power rating of from 3 to 8 kilowatts.

7. A method as recited in claim 1 wherein the abrasive material comprises tungsten carbide grit.

8. A method as recited in claim 7 wherein the abrasive tungsten carbide grit has a grit size between about 30 and 40 grit.

9. A method as recited in claim 1 wherein the abrasive material is a ceramic material selected from the group consisting of silica, alumina, silicon carbide, zirconia and tungsten carbide.

10. A refiner plate for a disc-type refining apparatus for refining fibrous material, said refiner plate comprising a metallic annular disc having an inner radius and an outer radius and an annular comminuting surface therebetween, at least a region of said comminuting surface comprising an abrasive surface formed by particles of an abrasive material deposited onto said comminuting surface while said comminuting surface was in a molten state and bonded to said comminuting surface upon solidification of the molten comminuting surface.

11. A refiner plate as recited in claim 10 wherein the abrasive material is a ceramic material.

12. A refiner plate as recited in claim 11 wherein the ceramic material is selected from the group consisting of silica, alumina, silicon carbide, zirconia and tungsten carbide.

13. A refiner plate as recited in claim 10 wherein the abrasive material comprises tungsten carbide grit.

14. A refiner plate as recited in claim 13 wherein the tungsten carbide grit has a grit size between about 30 and 40 grit.

15. A refiner plate for a disc-type refining apparatus for refining fibrous material, said refiner plate comprising a metallic annular disc formed of a plurality of truncated circular sector shaped refiner elements disposed in circumferentially adjacent relationship, each of said truncated circular sector shaped refiner elements having an inner radius and an outer radius and an annular comminuting surface therebetween, at least a region of said comminuting surface comprising an abrasive surface formed by particles of an abrasive material deposited onto said comminuting surface while said comminuting surface was in a molten state and bonded to said comminuting surface upon solidification of the molten comminuting surface.

16. A refiner plate as recited in claim 15 wherein the abrasive material is a ceramic material.

17. A refiner plate as recited in claim 16 wherein the ceramic material is selected from the group consisting of silica, alumina, silicon carbide, zirconia and tungsten carbide.

18. A refiner plate as recited in claim 15 wherein the abrasive material comprises tungsten carbide grit.

19. A refiner plate as recited in claim 18 wherein the tungsten carbide grit has a grit size between about 30 and 40 grit.

20. A refiner element for the refining of fibrous materials comprising a truncated circular sector of metallic material having an inner radius and an outer radius and a comminuting surface therebetween defining a first refining zone adjacent the inner radius of said refiner element and at least a second refining zone lying radially outward from the first refining zone, said first refining zone having grooves and ridges formed thereon and said second refining zone having an abrasive surface formed by particles of an abrasive material deposited onto said comminuting surface while said comminuting surface being in a molten state and bonded to said comminuting surface upon solidification of the molten communicating surface of said second refining zone.

21. A refiner element as recited in claim 20 wherein the abrasive material is a ceramic material.

22. A refiner element as recited in claim 21 wherein the ceramic material is selected from the group consisting of silica, alumina, silicon carbide, zirconia and tungsten carbide.

23. A refiner element as recited in claim 22 wherein the abrasive material comprises tungsten carbide grit.

24. A refiner element as recited in claim 23 wherein the tungsten carbide grit has a grit size between about 30 and 40 grit.

25. A refiner element as recited in claim 20 further comprising a third refining zone lying radially outward from the second zone, said third refining zone having grooves and ridges formed thereon.

26. A refiner element as recited in claim 20 wherein said second refining zone has a substantially flat comminuting surface to which the abrasive material is bonded.

27. A refiner plate as recited in claim 26 wherein the abrasive material is a ceramic material.

28. A refiner plate as recited in claim 27 wherein the ceramic material is selected from the group consisting of silica, alumina, silicon carbide, zirconia and tungsten carbide.

29. A refiner plate as recited in claim 28 wherein the abrasive material comprises tungsten carbide grit.

30. A refiner plate as recited in claim 29 wherein the tungsten carbide grit has a grit size between about 30 and 40 grit.

31. A refiner element as recited in claim 20 wherein the comminuting surface in said second refining zone has a plurality of ridges and grooves formed thereon, the abrasive grit being bonded to at least one of the upper surfaces of said ridges or the surface of said grooves.

32. A refiner plate as recited in claim 31 wherein the abrasive material is a ceramic material.

33. A refiner plate as recited in claim 32 wherein the ceramic material is selected from the group consisting of silica, alumina, silicon carbide, zirconia and tungsten carbide.

34. A refiner plate as recited in claim 33 wherein the abrasive material comprises tungsten carbide grit.

35. A refiner plate as recited in claim 34 wherein the tungsten carbide grit has a grit size between about 30 and 40 grit.

* * * * *